US005890539A

United States Patent [19]

Huber et al.

[11] Patent Number: 5,890,539

[45] Date of Patent: Apr. 6, 1999

[54] TUBING-CONVEYER MULTIPLE FIRING HEAD SYSTEM

[75] Inventors: Klaus B. Huber, Sugar Land; A. Glen Edwards, Hockley; Joe C. Hromas, Sugar Land; Laurent E. Muller, Stafford; Nathan E. Addicks, Sugar Land, all of Tex.

[73] Assignee: Schlumberger Technology Corporation, Sugar Land, Tex.

[21] Appl. No.: 795,609

[22] Filed: Feb. 5, 1997

[51] Int. Cl.[6] ..... E21B 43/117

[52] U.S. Cl. ..... 166/297; 166/55.2

[58] Field of Search ..... 166/297, 55.1, 166/51, 55.2, 55, 311, 298

[56] References Cited

U.S. PATENT DOCUMENTS

| | | | |
|---|---|---|---|
| 3,717,095 | 2/1973 | Vann . | |
| 4,496,010 | 1/1985 | Chapman, III . | |
| 4,523,643 | 6/1985 | McGlothen | 166/297 |
| 4,541,486 | 9/1985 | Wetzel et al. | 166/51 X |
| 4,544,034 | 10/1985 | George | 166/297 |
| 4,606,409 | 8/1986 | Peterson et al. . | |
| 4,612,992 | 9/1986 | Vann et al. . | |
| 4,616,718 | 10/1986 | Gambertoglio . | |
| 4,619,333 | 10/1986 | George . | |
| 4,629,001 | 12/1986 | Miller et al. . | |
| 4,678,044 | 7/1987 | George et al. . | |
| 4,817,718 | 4/1989 | Nelson et al. | 166/297 |
| 4,880,056 | 11/1989 | Nelson et al. | 166/51 |
| 4,917,187 | 4/1990 | Burns et al. | 166/297 |
| 4,969,525 | 11/1990 | George et al. . | |
| 5,078,210 | 1/1992 | George . | |
| 5,103,912 | 4/1992 | Flint . | |
| 5,115,865 | 5/1992 | Carisella et al. . | |
| 5,161,616 | 11/1992 | Colla . | |
| 5,287,924 | 2/1994 | Burleson et al. . | |
| 5,505,261 | 4/1996 | Huber et al. . | |
| 5,709,265 | 1/1998 | Haugen et al. | 166/55.2 |

OTHER PUBLICATIONS

Bussear, "Remote actuation system speeds deepwater well completions," *Oil & Gas Journal* 94:56–59 (1996).

*Primary Examiner*—Frank Tsay
*Attorney, Agent, or Firm*—Gordon G. Waggett; John J. Ryberg

[57] ABSTRACT

An apparatus for sequentially performing multiple downhole functions in a well has tubing arranged to transmit pressure conditions from the surface of the well, upper and lower hydraulically activated firing heads suspended within the well on the lower end of the tubing, and a hydraulically responsive movable member between the tubing and the firing heads. Each firing head is configured to detonate an associated tool in response to an associated elevated tubing pressure condition. The movable member transmits a first elevated pressure condition to activate one of the firing heads, and moves in response to a subsequent elevated pressure condition to activate the other firing head. In one embodiment, the movable member has a through passage for transmitting the first elevated pressure condition, the passage being subsequently blocked by a ball dropped through the tubing to move the member in response to the second elevated tubing pressure condition. In a second embodiment, the movable element is a free floating piston, with a stem which moves in response to the second elevated pressure condition. In other embodiments more than two firing heads are employed. Methods of sequentially performing multiple downhole functions in a well by such an apparatus are also disclosed.

20 Claims, 6 Drawing Sheets

TUBING-CONVEYER MULTIPLE FIRING HEAD SYSTEM

BACKGROUND OF THE INVENTION

In the process of completing an oil or gas well, it is common to lower tool strings into the well on long lengths of tubing, typically from a coiled roll. The tubing serves not only to support the weight of the string of tools in the well, but also to transmit pressure from the surface of the well for activating the tools to perform various functions, such as sealing the well bore or perforating the well casing for access to product-bearing deposits. Such systems are sometimes referred to as tubing-conveyed perforating systems, or "TCP" systems.

Downhole ballistic tools of such systems are typically detonated by an attached firing head which, in the case of TCP systems, is hydraulically activated from the surface of the well. Good examples of such hydraulically activated TCP firing heads are disclosed by Huber et al. in U.S. Pat. No. 5,505,261, issued Apr. 9, 1996 and incorporated herein by reference as if entirely set forth. Huber et al. discloses three examples of TCP firing heads referred to as Circulation Direction Firing (CDF), Circulation Ball Firing (CBF) and Ball-actuated Circulation Firing (BCF) heads, each of which receives tubing pressure from the surface of the well to activate the firing head to detonate an associated tool.

Several of such firing heads have been successfully employed in field operations and have been received favorably in the market.

Because of the cost advantages of performing as many functions as possible with one trip down the well, several attempts have been made to combine multiple firing heads into a single string to be remotely operated by tubing pressure. Among these is a system described by Burleson et al. in U.S. Pat. No. 5,287,924, which discloses selective communication devices between each of the firing heads in the string.

Another such system is described by Edwards et al. in U.S. Ser. No. 08/752,810, filed Nov. 20, 1996, entitled "Device and Method for Performing Downhole Functions", which employs hydro-mechanical locks associated with each firing head.

SUMMARY OF THE INVENTION

The inventors have realized the commercial need for a system which enables the combination of multiple TCP firing heads, already in broad commercial use individually, in a tool string which is not much longer than the stack length of the firing heads and their associated tools.

According to one aspect of the invention, an apparatus for sequentially performing multiple downhole functions in a well comprises tubing arranged to transmit pressure conditions from the surface of the well, and upper and lower hydraulically-activated firing heads arranged to be suspended in the well at the lower end of the tubing. Each firing head is configured to detonate an associated tool in response to an associated elevated tubing pressure condition. A hydraulically responsive, downhole movable member, disposed above the firing heads, is constructed to transmit a first elevated tubing pressure condition to activate one of the upper and lower firing heads. The movable member, or at least a part thereof, is arranged to move, in response to a subsequent elevated tubing pressure condition, to activate the other of the firing heads.

In one embodiment, the movable member has a through passage defined therein, the through passage arranged to transmit tubing pressure to activate the upper firing head without substantial movement of the movable member.

In one configuration, the movable member, upon closure of the passage, is responsive to tubing pressure to move to activate the lower firing head. In the presently preferred configuration the movable member defines a valve seat exposed to receive a sealing member to close the passage.

In some embodiments the movable member is disposed within a housing which defines a port for fluid communication between the tubing and the lower firing head. The movable member is responsive, upon closure of the passage, to move downward in response to tubing pressure to expose the port to tubing pressure to activate the lower firing head.

In one embodiment, the movable member has a sleeve defining an inner bore and a first ball seat for receiving a first ball through the tubing to plug the bore to enable the subsequent elevated tubing pressure condition to move the sleeve to expose the port to tubing pressure to activate the lower firing head. In some cases, the upper firing head has a second ball seat for receiving a second ball, of a smaller diameter than the first ball, from the tubing through the inner bore of the movable member, prior to the receipt of the first ball, to plug the second ball seat to enable the first elevated tubing pressure condition to activate the upper firing head.

In the present arrangement, the upper firing head has a further movable member defining the second ball seat. The second movable member is constructed to move in response to the subsequent elevated tubing pressure condition to activate the upper firing head.

In another embodiment, the movable member comprises a floating piston free to move within a limited range to transmit the first elevated tubing pressure condition to activate the lower firing head. In a presently preferred arrangement there is an initially closed volume of fluid between the floating piston and the lower firing head.

In some configurations the lower firing head is advantageously constructed to fire, after a predetermined length of time after being activated by the first elevated tubing pressure condition, to detonate its associated tool to perform a function and to open a hydraulic path between the volume of fluid and the well to release the volume of fluid to enable the movable member to subsequently move, in response to the subsequent elevated tubing pressure condition, an amount sufficient to activate the upper firing head.

In a present configuration the floating piston has an inner bore, an elongated stem portion disposed within the inner bore, and a stem securing means for securing the stem portion to the floating piston during the first elevated tubing pressure condition. The securing means is constructed to release the stem portion in response to the second elevated tubing pressure condition to enable the stem portion to move downwardly to activate the upper firing head.

In one embodiment the stem securing means comprises at least one shear pin.

In some embodiments the upper firing head has an activating piston constructed to activate the upper firing head when depressed. The stem portion of the movable member is arranged to move in response to the subsequent elevated tubing pressure condition to depress the activating piston.

In some particularly useful configurations there is at least one further firing head disposed below the lower firing head or between the upper and the lower firing heads.

According to another aspect of the invention a method of sequentially performing multiple downhole functions in a well comprises providing the apparatus described above, initiating the first elevated tubing pressure condition to activate the one of the firing heads, and initiating the second elevated tubing pressure condition to activate the other of the firing heads.

In one embodiment, the method further comprises the step, between initiating the first and second elevated tubing pressure condition, of introducing a ball through the tubing to plug a bore of the movable member to cause the movable member to be responsive to the second elevated tubing pressure condition to move to activate the other of the firing heads.

In one embodiment, the movable member of the provided apparatus comprises a floating piston having an inner bore, an elongated stem portion disposed within the inner bore, and a stem securing means for securing the stem portion to the floating piston during the first elevated tubing pressure condition. In this embodiment the method includes elevating tubing pressure to a level sufficient to release the stem portion from the floating piston and to propel the stem portion downward to activate the upper firing head.

In some particularly useful embodiments, the provided apparatus has at least one further firing head in addition to the upper and lower firing heads. In some of these embodiments the method further comprises the step of elevating well annulus pressure to activate the further firing head.

The present invention advantageously enables multiple firing heads to be arranged in a single string of tools to complete multiple downhole functions in a single trip down a well by permitting each of two firing heads to be independently operated by consecutive elevations in tubing pressure, without the function of the second firing head being dependent upon the successful detonation of the first.

The invention also makes use of many firing head systems and components currently available in the market, thus requiring little additional capital expenditure. The addition of the movable member to the tool string to enable sequential firing advantageously requires only a slight increase in the total length of the tool string.

DESCRIPTION OF THE PREFERRED EMBODIMENTS

Figure 1:
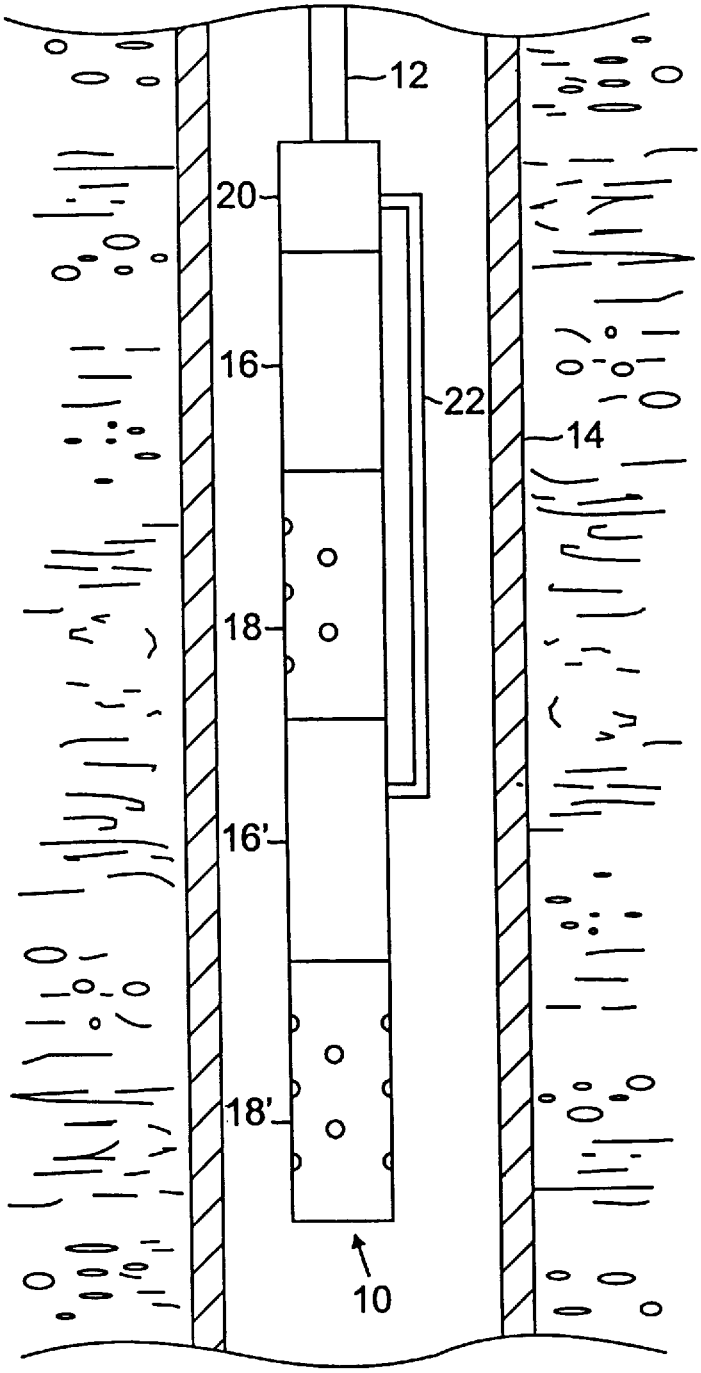
FIG. 1 schematically illustrates a string of tools in a well, according to the invention.

Referring to FIG. 1, a string 10 of tools for performing multiple downhole functions in a well is lowered on tubing 12 into well casing 14. String 10 has an upper firing head 16 and a lower firing head 16', each arranged to detonate an associated tool 18 and 18', respectively, in response to associated elevated pressure conditions within tubing 12. Disposed between upper firing head 16 and tubing 12 is an upper housing 20 which is hydraulically connected to lower firing head 16' by external tubing 22. Tools 18 and 18' may include among other things perforating guns, packer setting tools, and bridge plug setting tools.

Figure 2:
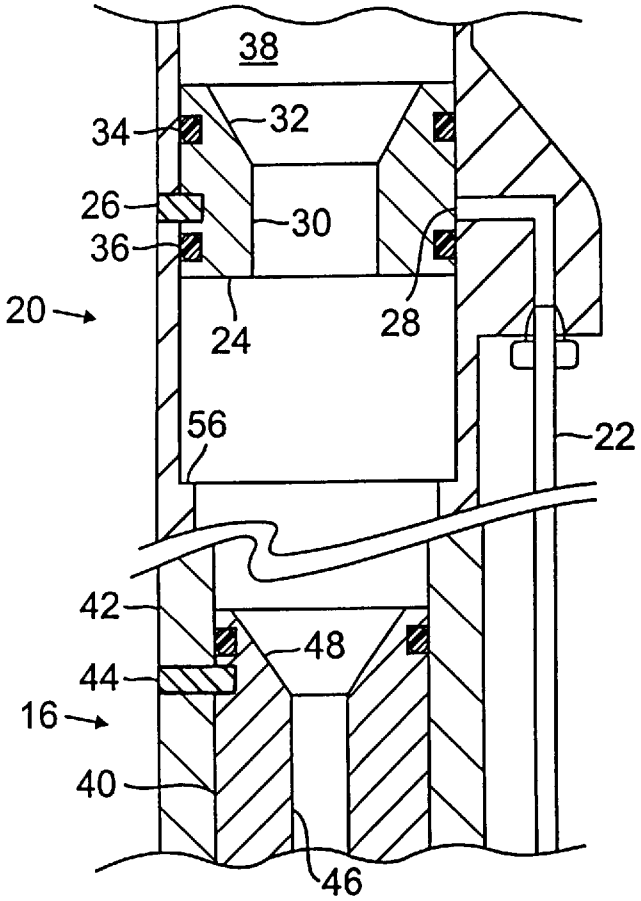

Referring to FIG. 2, upper housing 20 contains, in a first embodiment, a sleeve 24 initially retained in an axial position within housing 20 by a shear pin 26. Housing 20 further defines a side port 28 for hydraulic communication with external tubing 22 for transmitting pressure to lower firing head 16' (FIG. 1). Sleeve 24 has an inner bore 30 and defines a tapered valve seat 32. With sleeve 24 positioned as shown, o-ring seals 34 and 36 block the transmission of hydraulic pressure from inner housing cavity 38 to port 28. Cavity 38 is in hydraulic communication with tubing 12, such that hydraulic pressures originated at the surface of the well and transmitted down tubing 12 (FIG. 1) are received in cavity 38. Inner bore 30 of sleeve 24 enables such pressures to be transmitted through sleeve 24 to upper firing head 16, which has a movable element 40 pinned to a housing 42 by shear pin 44.

Movable element 40 of upper firing head 16 also has an inner bore 46 and defines a tapered valve seat 48, with inner bore 46 being of a smaller diameter than bore 30 of sleeve 24.

Figure 3:
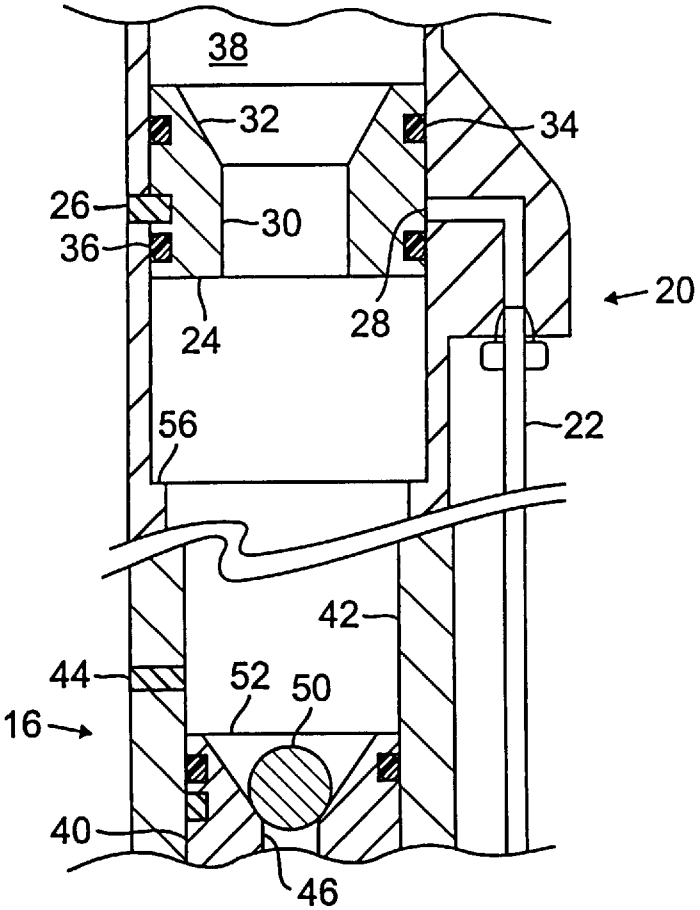
FIGS. 2–4 are cross-sectional views sequentially illustrating the function of a first embodiment of the movable member of the tool string of FIG. 1.

As shown in FIG. 3, the difference in the diameters of inner bores 30 and 46 of sleeve 24 and movable element 40, respectively, allows a ball 50, dropped from the surface of the well through the tubing, to pass freely through sleeve 24 and seat against valve seat 48 in upper firing head 16, thereby blocking bore 46 and enabling hydraulic pressure in bore 38, acting against the upper surface 52 of movable element 40, to shear pin 44 and force sliding element downward to activate upper firing head 16 to detonate its associated tool.

During the hydraulic activation of upper firing head 16, port 28 is blocked from tubing pressure (i.e. the pressure in cavity 38) by O-ring seals 34 and 36. So blocked, port 28 does not transmit tubing pressures through tubing 22 to the lower firing head that would otherwise activate that firing head.

Figure 4:
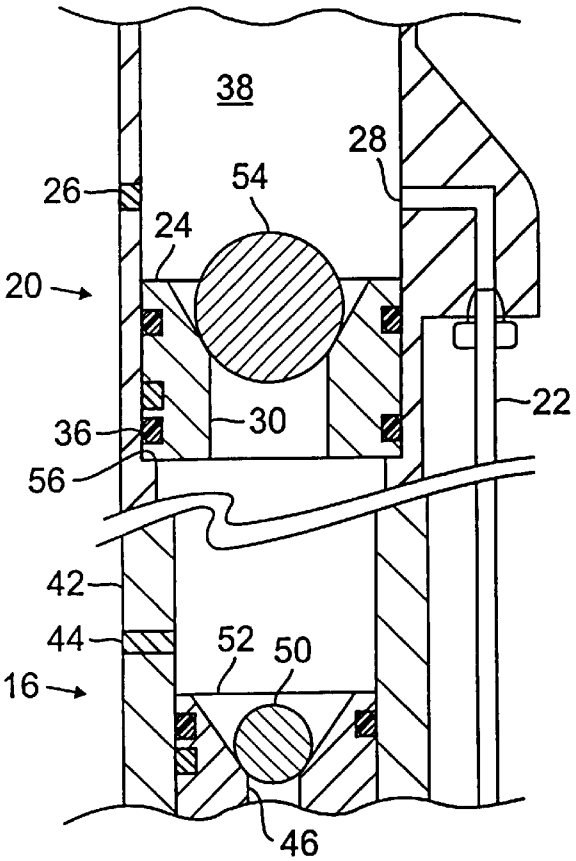

Referring to FIG. 4, after the detonation of the tool associated with upper firing head 16 a larger ball 54 is dropped through the tubing from the surface of the well to block bore 30 of sleeve 24. A subsequent increase in tubing pressure, i.e. the pressure in cavity 38, causes sleeve 24 to move downward to rest against shoulder 56, shearing pin 26 and exposing port 28 to tubing pressure, which is subsequently transmitted through tubing 22 to a lower firing head to detonate the tool associated with the lower firing head.

Figure 5:
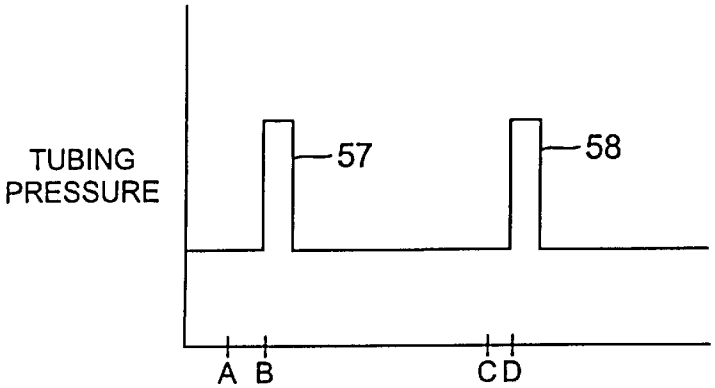
FIG. 5 shows a tubing pressure chronology for operating the first embodiment of FIGS. 2–4.

FIG. 5 illustrates the timing of the sequence of events associated with the operation of the embodiment of FIGS. 2–4, showing tubing pressure plotted as a function of time. Event A, the dropping of the first, smaller ball to close inner bore 46 within upper firing head 16, is followed by a first elevated tubing pressure condition 57 which causes the detonation B of the tool associated with the upper firing head. Afterwards, the larger ball is dropped through the tubing (event C), blocking the passage through sleeve 24 and enabling a second elevated tubing pressure condition 58 to move sleeve 24 to expose lower firing head 16' (FIG. 1) to tubing pressure to fire lower firing head (event D).

FIGS. 6–10 illustrate a second embodiment of the invention.

Figure 6:
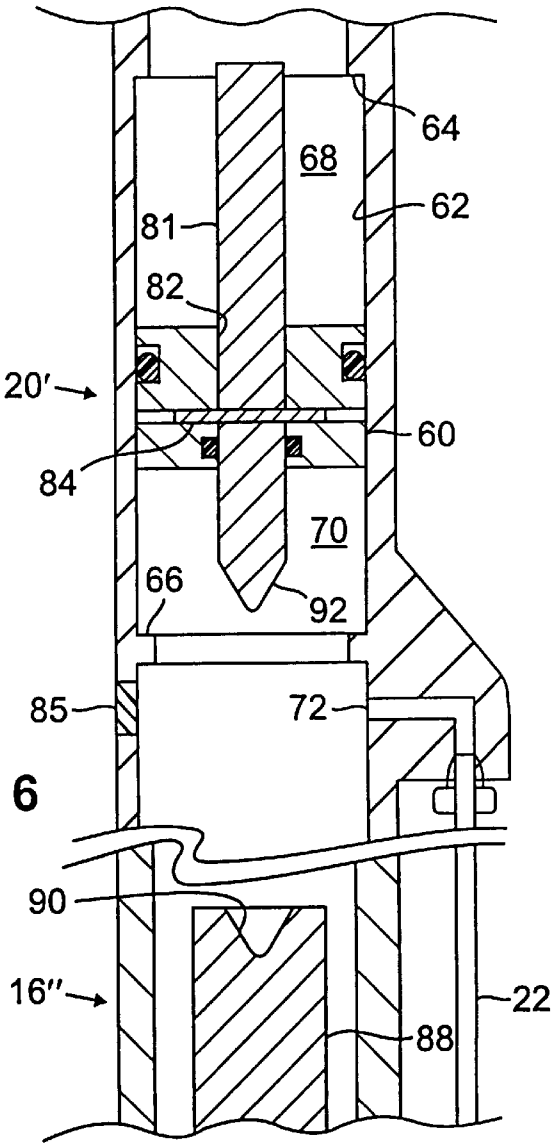
FIGS. 6–8 sequentially illustrate the function of a second embodiment of the upper member of the tool string.
Figure 9:
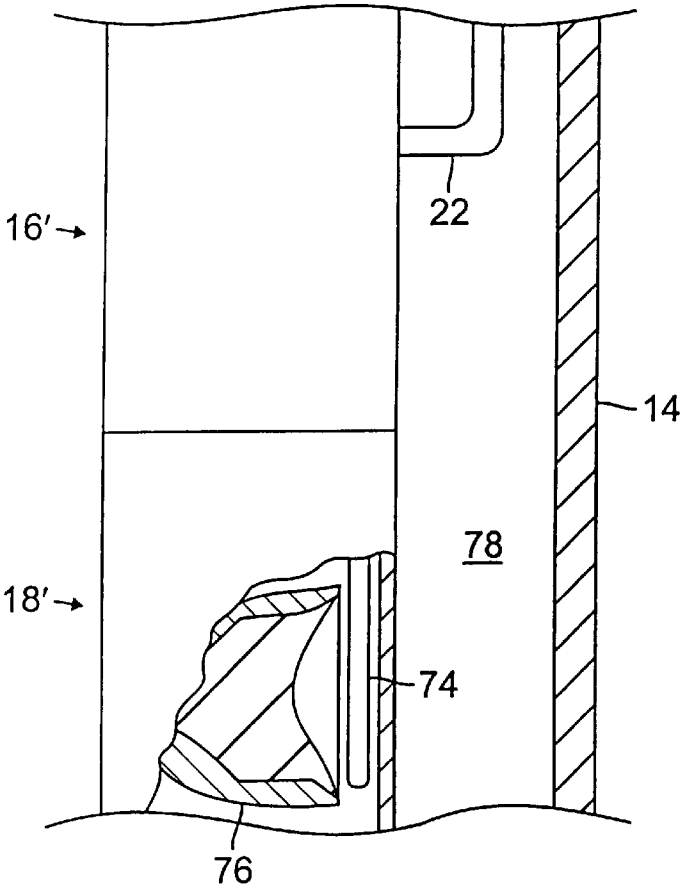
FIG. 9 is a partial cut-away view of the lower firing head and tool employed with the second embodiment of FIGS. 6–8.

Referring first to FIGS. 6 and 9, a free floating piston 60 is disposed to move freely in a longitudinal sense within an inner bore 62 of upper housing 20' between upper and lower stops 64 and 66, respectively. Piston 60 thus divides the interior of bore 62 into an upper chamber 68, which is in constant hydraulic communication with tubing pressure from the surface of the well, and a lower chamber 70 which is in hydraulic communication with lower firing head 16' through a side port 72 and external tubing 22.

Lower chamber 70, external tubing 22, lower firing head 16' and internal hydraulic passages within lower tool 18' (schematically represented by tubing extension 74) together define an initially closed volume of fluid. Tubing pressure in cavity 68 exerted upon piston 60 compresses this closed volume of fluid, increasing the pressure inside chamber 70, lower firing head 16' and tubing extension 74 of tool 18'.

As illustrated in FIG. 9, tubing extension 74 is arranged to be destroyed by the firing of an adjacent charge 76 in tool 18', thus opening a hydraulic communication path from the interior of tubing extension 74 to well annulus 78 upon the detonation of tool 18', releasing the previously closed volume of fluid below piston 60 (FIG. 6).

Figure 10:
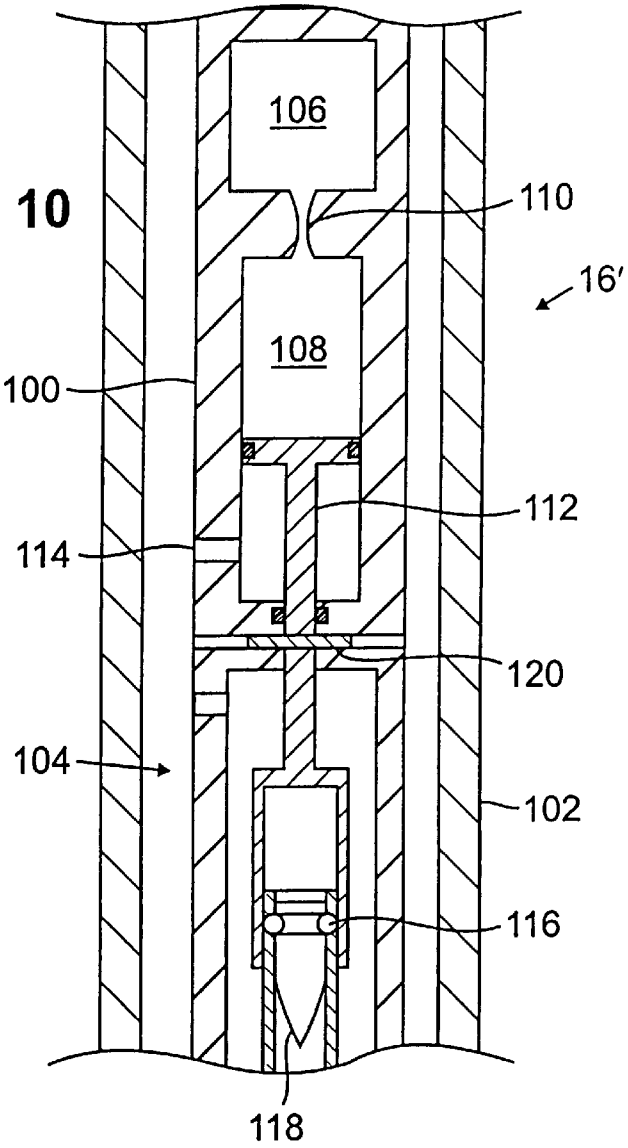
FIG. 10 is a schematic illustration of a firing head with a time delay feature.

Referring to FIG. 10, in one preferred embodiment lower firing head 16' is constructed to delay detonating lower tool 18' (FIG. 1) until after a predetermined length of time, $T_d$. Firing head 16' has an inner assembly 100 contained within a fill sub 102. The annular region 104 between fill sub 102 and assembly 100 is in hydraulic communication with tubing 22 (FIG. 1). Assembly 100 has two internal chambers 106 and 108, separated by an orifice 110. Chamber 106 initially contains compressible air and chamber 108 contains oil. A piston 112, exposed to region 104 through port 114, is arranged to move upward under tubing pressure to force the oil in chamber 108 through orifice 110. When piston 112 has moved a sufficient distance, it exposes balls 116, thereby releasing firing pin 118, which is accelerated under tubing pressure forces to detonate the lower tool. A shear pin 120 retains piston 112 from moving until region 104 reaches a sufficient pressure. Due in part to the viscosity of the oil in chamber 108 and the size of orifice 110, there is a time delay $T_d$ (FIG. 11) between the application of sufficient pressure to region 104 to break shear pin 120 and the release of firing pin 118.

Figure 11:
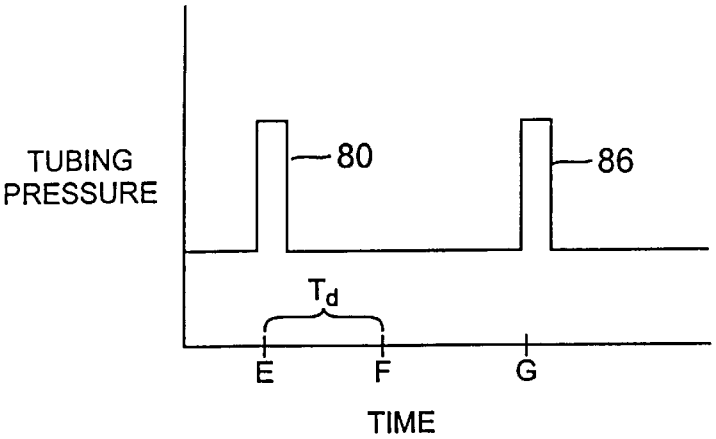
FIG. 11 shows a tubing pressure chronology for operating the second embodiment of FIGS. 6–8.

Referring to FIGS. 9 and 11, in use a first elevated pressure condition 80 is transmitted across piston 60 to pressurize lower chamber 70 and hydraulically activate lower firing head 16'. Event E is the activation of lower firing head 16' and event F is the firing of lower tool 18'. Delay time $T_d$ between E and F is sufficient for the surface operator to reduce tubing pressure to a level which is approximately equal to the pressure inside well annulus 78 prior to the firing of lower tool 18'.

Referring back to FIG. 7, after the volume of fluid below piston 60 has been opened to the well annulus by the detonation of lower tool 18', piston 60 is free to move downward to lower stop 66 of bore 62. Floating piston 60 has an elongated stem 80 disposed within a sealed inner bore 82 and initially secured to the floating piston by a shear pin 84. Shear pin 84 secures stem 81 to piston 60 during the first elevated pressure condition 80 which was transmitted through piston 60 to activate lower firing head 16'. Because tubing pressure has been reduced to well annulus pressure by the time piston 60 has reached lower stop 62, the pressures in upper and lower chambers 68 and 70 are approximately equal. A rupture disk 85 is provided between lower chamber 70 and the well bore to enable the volume of fluid below piston 60 to be opened in the event that the volume of fluid fails to be opened by other means. Rupture disk 85 is breached by applying a higher elevated tubing pressure condition than that required to actuate the lower firing head.

Figure 8:
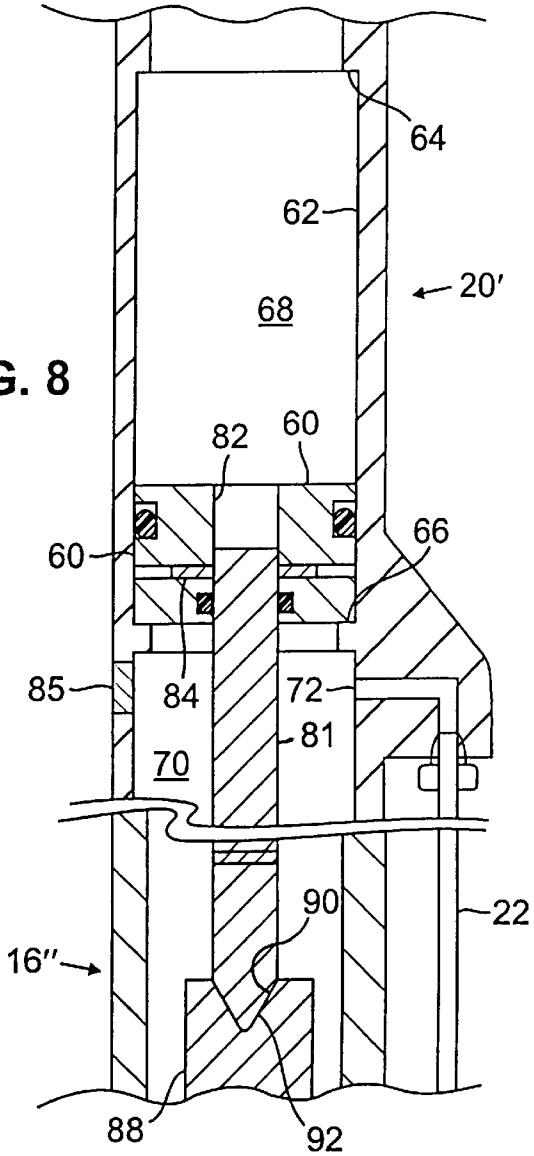
Figure 7:
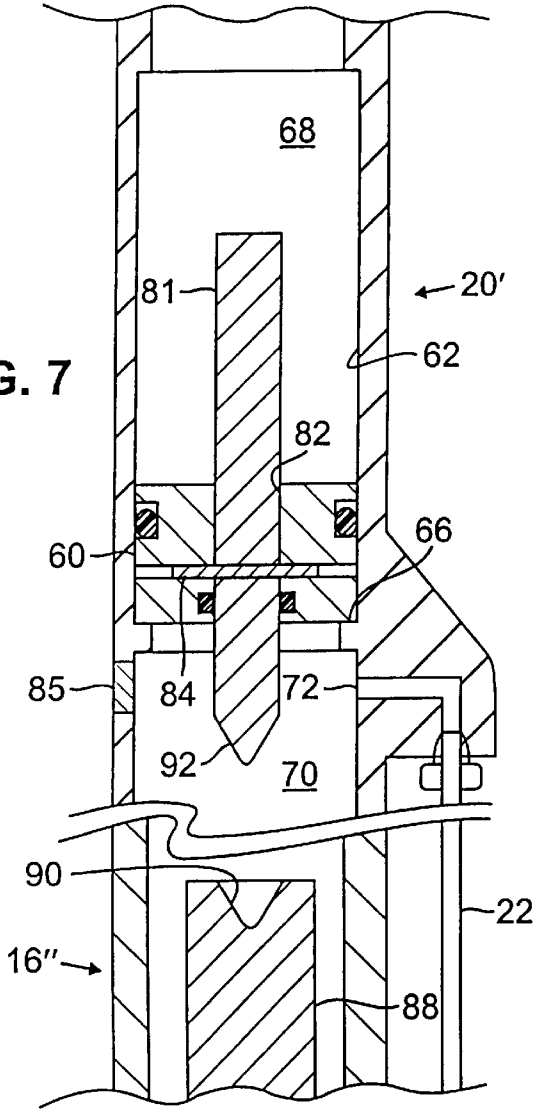

Referring to FIGS. 8 and 11, upper firing head 16" has an inner activating piston element 88 which is configured with an upper recess 90 to receive the lower end 92 of stem 81. A second elevated pressure condition 86 acting on the upper end of stem 81 shears pin 84 and forces stem 81 downward to depress activating piston element 88 of upper firing head 16" to detonate its associated tool (event G). Thus floating piston 60 and its stem 81 function to transmit a first elevated pressure 80 to activate lower firing head 16' (event E), and also move downward to cause upper firing head 16" to detonate (event G).

Figure 12:
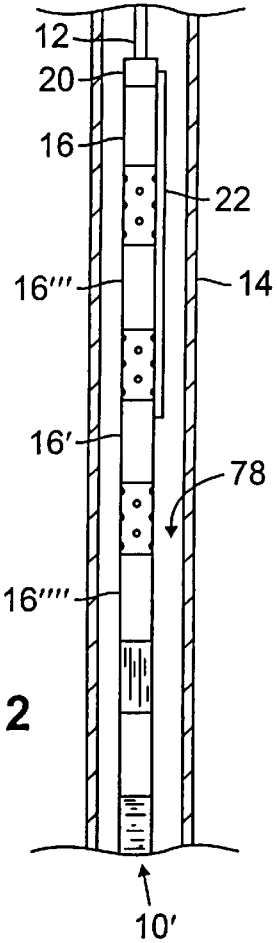
FIG. 12 shows another embodiment of the tool string with additional firing heads.

Other embodiments will be evident to those skilled in the art. For example, as shown in FIG. 12, additional firing heads 16''', 16'''', etc. can be added to tool string 10' to perform more than two functions within the well. These additional firing heads can either be located between upper head 16 and lower head 16', e.g. firing head 16''', or below lower head 16', e.g. firing head 16''''. Firing heads 16''' and 16'''' can be activated by any number of means, including changing pressure conditions inside well annulus 78.

Although in both embodiments shown the hydraulic connection between upper housing 20 (or 20') and lower firing head 16' has been in the form of external tubing 22, in other embodiments (not shown) internal passages are arranged within the housing structure of the tool string to transmit tubing pressure to activate lower firing head 16'. In other words, some embodiments of the invention replace external tubing 22 with internal passages that perform the same function of transmitting tubing pressure to the lower firing head.

What is claimed is:

1. An apparatus for sequentially performing multiple downhole functions in a well comprising tubing arranged to transmit pressure conditions from the surface of the well, upper and lower hydraulically-activated firing heads arranged to be suspended in the well at the lower end of the tubing, each configured to detonate an associated tool in response to an associated elevated tubing pressure condition, and a hydraulically responsive, downhole movable member disposed above the firing heads, the movable member constructed to transmit a first elevated tubing pressure condition to activate one of said upper and lower firing heads, the movable member, or at least a part thereof, further being arranged to move, in response to a subsequent elevated tubing pressure condition, to activate the other of said firing heads.

2. The apparatus of claim 1 wherein said movable member has a through passage defined therein, said through passage arranged to transmit tubing pressure to activate said upper firing head without substantial movement of said movable member.

3. The apparatus of claim 2 wherein said movable member, upon closure of said passage, is responsive to tubing pressure to move to activate said lower firing head.

4. The apparatus of claim 3 wherein said movable member defines a valve seat exposed to receive a sealing member to close said passage.

5. The apparatus of claim 2 wherein said movable member is disposed within a housing which defines a port for fluid communication between said tubing and said lower firing head, said movable member being responsive, upon closure of said passage, to move downward in response to tubing pressure to expose said port to tubing pressure to activate said lower firing head.

6. The apparatus of claim 5 wherein said movable member comprises a sleeve defining an inner bore and a first ball seat for receiving a first ball through said tubing to plug said bore to enable said subsequent elevated tubing pressure condition to move said sleeve to expose said port to tubing pressure to activate said lower firing head.

7. The apparatus of claim 6 wherein said upper firing head has a second ball seat for receiving a second ball, of a smaller diameter than said first ball, from said tubing through the inner bore of said movable member, prior to the receipt of said first ball, to plug said second ball seat to enable said first elevated tubing pressure condition to activate said upper firing head.

8. The apparatus of claim 7 wherein said upper firing head has a further movable member defining said second ball seat, said second movable member constructed to move in response to said subsequent elevated tubing pressure condition to activate said upper firing head.

9. The apparatus of claim 1 wherein said movable member comprises a floating piston free to move within a limited range to transmit said first elevated tubing pressure condition to activate said lower firing head.

10. The apparatus of claim 9 further comprising an initially closed volume of fluid between said floating piston and said lower firing head.

11. The apparatus of claim 10 wherein the lower firing head is constructed to fire, after a predetermined length of time after being activated by said first elevated tubing pressure condition, to detonate its associated tool to perform a function and to open a hydraulic path between said volume of fluid and said well to release said volume of fluid to enable said movable member to subsequently move, in response to said subsequent elevated tubing pressure condition, an amount sufficient to activate said upper firing head.

12. The apparatus of claim 11 wherein said floating piston has an inner bore, an elongated stem portion disposed within said inner bore, and a stem securing means for securing said stem portion to said floating piston during said first elevated tubing pressure condition, said securing means constructed to release said stem portion in response to said second elevated tubing pressure condition to enable said stem portion to move downwardly to activate said upper firing head.

13. The apparatus of claim 12 wherein said stem securing means comprises at least one shear pin.

14. The apparatus of claim 12 wherein said upper firing head has an activating piston constructed to activate said upper firing head when depressed, the stem portion of said movable member being arranged to move in response to said subsequent elevated tubing pressure condition to depress said activating piston.

15. The apparatus of claim 2 or claim 9 further comprising at least one further firing head disposed below said lower firing head.

16. The apparatus of claim 2 or claim 9 further comprising at least one further firing head disposed between said upper and said lower firing heads.

17. A method of sequentially performing multiple downhole functions in a well comprising providing an apparatus having tubing arranged to transmit pressure conditions from the surface of the well, upper and lower hydraulically-activated firing heads arranged to be suspended in the well at the lower end of the tubing and to detonate an associated tool in response to an associated elevated tubing pressure condition, and a hydraulically responsive, movable member disposed above the firing heads, the movable member constructed to transmit a first elevated tubing pressure condition to activate one of said upper and lower firing heads, the movable member, or at least a part thereof, further being arranged to move, in response to a subsequent elevated tubing pressure condition, to activate the other of said firing heads, initiating said first elevated tubing pressure condition to activate said one of said firing heads, and initiating said second elevated tubing pressure condition to activate said other of said firing heads.

18. The method of claim 17 further comprising, between initiating said first and second elevated tubing pressure condition, the step of introducing a ball through said tubing to plug a bore of said movable member to cause said movable member to be responsive to said second elevated tubing pressure condition to move to activate said other of said firing heads.

19. The method of claim 17 wherein the movable member of the provided apparatus comprises a floating piston having an inner bore, an elongated stem portion disposed within said inner bore, and a stem securing means for securing said stem portion to said floating piston during said first elevated tubing pressure condition, the method including elevating tubing pressure to a level sufficient to release said stem portion from said floating piston and to propel said stem portion downward to activate said upper firing head.

20. The method of claim 17 wherein the provided apparatus has at least one further firing head in addition to said upper and lower firing heads, further comprising the step of elevating well annulus pressure to activate said further firing head.

* * * * *